US007585051B2

(12) United States Patent
Unno

(10) Patent No.: US 7,585,051 B2
(45) Date of Patent: Sep. 8, 2009

(54) LIQUID EJECTION HEAD

(75) Inventor: Yasuko Unno, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 400 days.

(21) Appl. No.: 11/447,059

(22) Filed: Jun. 6, 2006

(65) Prior Publication Data

US 2006/0274118 A1 Dec. 7, 2006

(30) Foreign Application Priority Data

Jun. 6, 2005 (JP) ..... 2005-165756

(51) Int. Cl.
*B41J 2/04* (2006.01)
*B41J 2/05* (2006.01)

(52) U.S. Cl. ..... 347/54; 347/55

(58) Field of Classification Search ..... 347/40, 347/44, 54, 55, 65, 74, 75, 112, 127, 76; 346/150.1, 150.2
See application file for complete search history.

(56) References Cited

U.S. PATENT DOCUMENTS 6,158,844 A 12/2000 Murakami et al.
6,908,177 B2 * 6/2005 Suganuma ..... 347/55
7,182,450 B2 * 2/2007 Aoshima ..... 347/95
7,182,454 B2 * 2/2007 Nakazawa ..... 347/102
7,278,714 B2 * 10/2007 Kaneko ..... 347/55
7,287,835 B2 * 10/2007 Kaneko et al. ..... 347/55
7,296,879 B2 * 11/2007 Fukunaga et al. ..... 347/54
7,303,614 B2 * 12/2007 Kasai ..... 106/31.33
7,311,384 B2 * 12/2007 Nakazawa et al. ..... 347/55
7,419,248 B2 * 9/2008 Furukawa ..... 347/55

FOREIGN PATENT DOCUMENTS

JP 9-277558 A 10/1997
JP 10-67111 A 3/1998
JP 10-230608 A 9/1998
JP 11-10911 A 1/1999
JP 2001-121716 A 5/2001

* cited by examiner

*Primary Examiner*—Stephen D Meier
*Assistant Examiner*—Rene Garcia, Jr.
(74) *Attorney, Agent, or Firm*—Sughrue Mion, PLLC

(57) ABSTRACT

A liquid ejection head includes ejection ports ejecting as droplets a solution containing colorant particles dispersed therein and a device that makes uniform ejection of the solution from respective ejection channels in an ejection channel region where the ejection ports are arranged. A liquid ejection head of electrostatic type makes an electrostatic force to act on the solution containing charged particles dispersed therein as the colorant particles to eject the droplets.

17 Claims, 6 Drawing Sheets

LIQUID EJECTION HEAD

The entire contents of documents cited in this specification are incorporated herein by reference.

BACKGROUND OF THE INVENTION

The present invention relates to a liquid ejection head for ejecting a solution containing charged particles dispersed therein. More specifically, the invention relates to a liquid ejection head that ejects droplets by making an electrostatic force act on a solution containing charged particles dispersed therein.

Liquid ejection heads for ejecting liquid have been heretofore proposed as exemplified by a thermal type inkjet head which ejects ink droplets by the expansion force of bubbles generated in heated ink, and a piezoelectric type inkjet head which ejects ink droplets by applying a pressure to ink by means of a piezoelectric element.

Recently, another type of inkjet head has been also proposed in which ink containing a charged fine particle component is used and a predetermined voltage is applied to control electrodes of the inkjet head in accordance with image data to control ink ejection based on the electrostatic force to thereby record an image corresponding to the image data on a recording medium.

Various inkjet recording apparatuses are known to be of the electrostatic inkjet recording system (see, for example, JP 10-230608 A, JP 9-277558 A, JP 10-67111 A, JP 11-10911 A and JP 2001-121716 A).

The inkjet head adopting the electrostatic inkjet recording system is advantageous in that the problems having been heretofore pointed out: ink material restricted in the thermal type inkjet head because of partial heating of ink to 300° C. or higher, and complicated and high-cost structure of the piezoelectric type inkjet head can be solved.

The object to be achieved in the inkjet head of the inkjet recording apparatus disclosed in JP 10-230608 A was to consistently eject ink droplets without causing clogging. Each of the ink guides has an ink guide groove (slit) with a predetermined width formed by cutting and its tip portion is pointed, and it is said that the slit contributes to the meniscus stability. However, this apparatus suffers from its insufficient capability to supply ink particles and has a problem associated with continuous ejection in the high-frequency range.

The object to be achieved in the inkjet head recording apparatus disclosed in JP 9-277558 A was to prevent printing unevenness due to pressure head differences among the nozzles not by relying on the formation of ink guides but by forming an approximately hemispherical meniscus in each ink outlet port by means of the pressure of ink coming from the ink supply path and the surface tension of the ink. However, this apparatus has a limitation on the orientation of the nozzle heads and shaking of the nozzle heads may have a detrimental effect on the apparatus.

The object to be achieved in the inkjet head recording apparatus disclosed in JP 10-67111 A was to stabilize the ink concentration by circulating ink in a consistent manner and the apparatus is designed to absorb variations in the pressure difference between the ink chamber and the ink tank. However, this apparatus is not capable of correcting the non-uniformity of pressure among the channels in the head.

As in JP 10-67111 A, the inkjet recording apparatus disclosed in JP 11-10911 A is also capable of correcting the pressure difference between the inlet and outlet of the head by providing the pressure adjusting tube between the ink supply path and the ink recovery path, but the non-uniformity of pressure among the channels cannot be corrected.

The inkjet recording apparatus disclosed in JP 2001-121716 A has the ink pressure sensor disposed in the ink supply path to control the ink supplying pump so that a decrease in ink pressure can be detected before the apparatus is turned to an unprintable state. However, a method of compensating for the pressure variations among the channels in the head is not considered in this apparatus.

SUMMARY OF THE INVENTION

It is required that a uniform and high-quality image be recorded at high speed in a consistent manner with the inkjet head (liquid ejection head) of an inkjet recording apparatus. Recently, a so-called multihead inkjet head is used to meet the demand for further enhanced speed, and hence it is required that droplets be uniformly ejected from a large number of ejection ports.

That is, it is required that a uniform and high-quality image be recorded at high speed in a more consistent manner than before with the inkjet recording apparatus. In order to fulfill this requirement, it is necessary to consistently eject droplets of the same size under uniform pressure from droplet-ejecting positions (that is, from multichannel droplet-ejecting ports).

However, as described above, it has been generally impossible to respond to such requirement in inkjet heads used in conventional inkjet recording apparatuses.

The present invention has been made to solve the problems described above and an object of the present invention is to provide a liquid (ink) ejection head capable of consistently ejecting droplets of the same size under uniform pressure from multichannel ink ejection ports.

A more specific object of the present invention is to provide a liquid ejection head of electrostatic type which has multichannel ink ejection guides and are capable of consistently ejecting droplets of the same size under uniform pressure by making uniform the ejection of a solution from respective ejection channels in the region in which the ink ejection guides are arranged (hereinafter referred to as the ejection channel region).

In order to achieve the above objects, the present invention provides a liquid ejection head comprising:

ejection ports which eject as droplets a solution containing colorant particles dispersed therein; and means for making uniform ejection of the solution from respective ejection channels in an ejection channel region where the ejection ports are arranged.

The means for making uniform the ejection of the solution from the respective ejection channels preferably comprises means for locally increasing a pressure loss between a solution supply path for supplying the solution and the ejection channel region.

The means for making uniform the ejection of the solution from the respective ejection channels preferably comprises means for making solution surfaces formed in the respective ejection channels of the ejection channel region uniform in height.

The means for making uniform the ejection of the solution from the respective ejection channels preferably comprises means for making uniform one or both of a flow rate and a pressure at which the solution is supplied to the respective ejection channels of the ejection channel region.

In order to achieve the above objects, the present invention also provides a liquid ejection head of electrostatic type that makes an electrostatic force to act on a solution containing charged particles dispersed therein to eject droplets, comprising:

an insulating through-hole substrate through which through-holes for ejecting the droplets extend;

an insulating head substrate which is spaced apart from the insulting through-hole substrate by a predetermined distance, with a solution flow path being formed between the insulating through-hole substrate and the insulting head substrate;

solution guides which are formed on a surface of the insulating head substrate facing the insulating through-hole substrate, with their tips extending through and protruding from the insulating through-hole substrate;

control electrodes which ate provided at positions corresponding to the through-holes and causes the electrostatic force to act on the solution;

a counter electrode which is provided at a position facing the solution guides; and means for making uniform ejection of the solution from respective ejection channels in an ejection channel region where the solution guides are arranged.

The means for making uniform the ejection of the solution from the respective ejection channels preferably comprises means for locally increasing a pressure loss between a solution supply path for supplying the solution and the ejection channel region.

The means for making uniform the ejection of the solution from the respective ejection channels preferably comprises means for making meniscuses formed in the respective ejection channels of the ejection channel region uniform in height.

The means for making uniform the ejection of the solution from the respective ejection channels preferably comprises means for making uniform one or both of a flow rate and a pressure at which the solution is supplied to the respective ejection channels of the ejection channel region.

The means for making uniform the ejection of the solution from the respective ejection channels preferably comprises means for making uniform flow rates and pressures in a solution-flowing direction and in a width direction by locally increasing the pressure loss per unit length between the solution supply path and the ejection channel region.

The means for making uniform the flow rates and the pressures in the solution-flowing direction and in the width direction preferably comprises a baffle plate provided in the solution flow path.

The means for making uniform the flow rates and the pressures in the solution-flowing direction and in the width direction preferably comprises a porous member provided in the solution flow path.

The means for making uniform the flow rates and the pressures in the solution-flowing direction and in the width direction preferably comprises uneven structures having adjusted roughness and formed in the solution flow path or wall surfaces of the solution flow path having adjusted roughness.

The means for making uniform the flow rates and the pressures in the solution-flowing direction and in the width direction preferably comprises means for changing typical sizes of the solution flow path between the solution supply path and the ejection channel region.

The means for locally increasing the pressure loss preferably comprises means for changing between the solution supply path and the ejection channel region, a direction in which the solution mainly flows.

The means for making meniscuses formed in the respective ejection channels of the ejection channel region uniform in height preferably comprises means for reducing a pressure loss per unit length in the ejection channel region.

The means for reducing the pressure loss per unit length in the ejection channel region preferably comprises means for decreasing a contact area of wall surfaces of the solution flow path which make contact with the solution in the ejection channel region.

The wall surfaces of the solution flow path in the ejection channel region which make contact with the solution are preferably subjected to a coating treatment.

The wall surfaces of the solution flow path in the ejection channel region which make contact with the solution are preferably provided with microstructured projections or recesses.

The means for making uniform the one or both of the flow rate and the pressure at which the solution is supplied to the respective ejection channels of the ejection channel region preferably comprises means for supplying the solution to blocks each composed of more than one channel in the ejection channel region.

The means for supplying the solution to blocks each composed of the more than one channel in the ejection channel region preferably supplies the solution in parallel to blocks each composed of more than one channel in the ejection channel region.

The blocks each composed of the more than one channel are preferably separated from each other by partitions.

According to the present invention, a liquid ejection head capable of consistently ejecting droplets of the same size under uniform pressure from multichannel ink election ports can be realized.

More specifically, according to the present invention, the flow rates and the pressures in the ink flow direction and the width direction in the ejection channel region are made uniform, whereby the meniscuses formed in the ejection ports of the ejection channel region are made uniform in height and also have substantially the same shapes.

According to the present invention, the pressure loss per unit length in the ejection channel region is also reduced to decrease the pressure difference between the upstream and the downstream in the ink flow direction, which enables the ink flow rate to be made uniform. Thus, the meniscuses formed in the ejection ports of the ejection channel region are made uniform in height and also have substantially the same shapes.

Furthermore, the present invention that is configured so as to supply ink to each block composed of more than one channel is capable of making the ink-supplying pressure and flow rate uniform even when it is difficult to reduce the pressure loss in the ejection channel region.

DETAILED DESCRIPTION OF THE INVENTION

The liquid ejection head of the present invention will be described below in detail with reference to preferred embodiments shown in the accompanying drawings.

Figure 1:
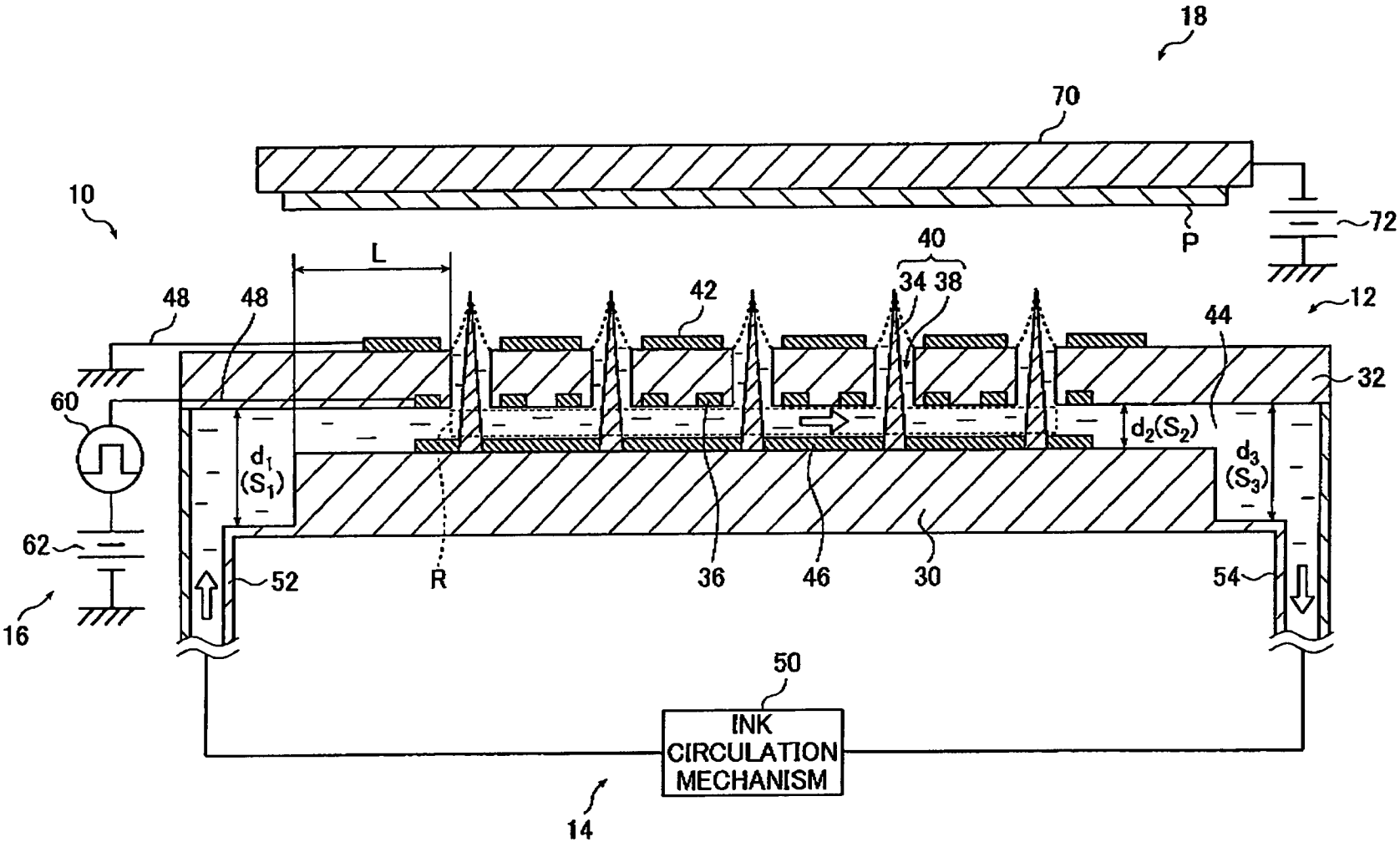
FIG. 1 is a schematic view of an inkjet recording apparatus that has an inkjet head which is an example of an electrostatic ejection head according to an embodiment of the present invention.
Figure 2:
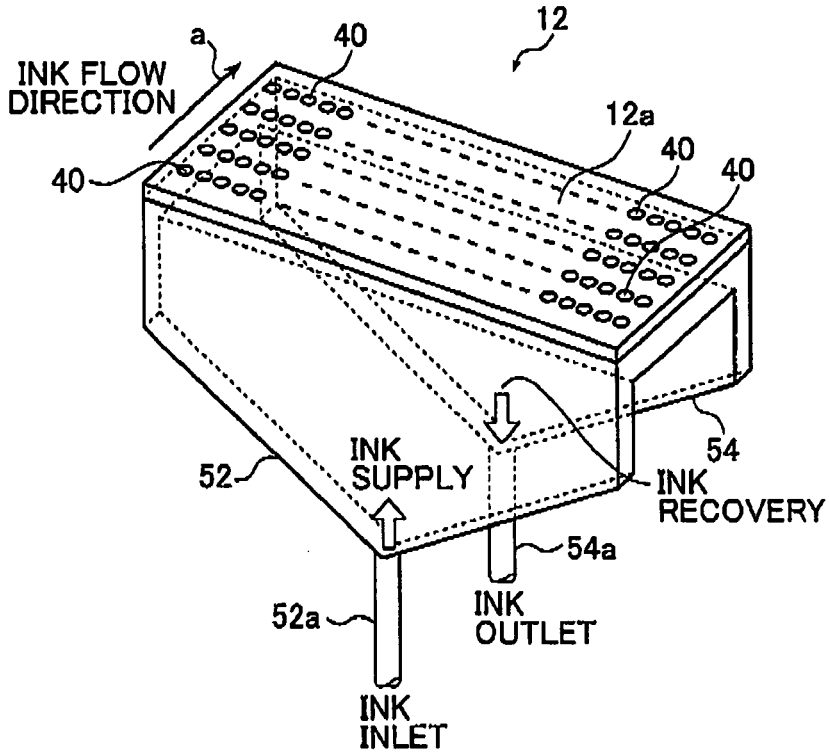
FIG. 2 is a perspective view showing the vicinity of an ejection channel region which is the essential part of the inkjet head shown in FIG. 1.

FIG. 1 is a schematic view of an inkjet recording apparatus 10 that has an inkjet head 12 which is an example of an electrostatic ejection head according to an embodiment of the present invention. FIG. 2 is a perspective view showing the vicinity of an ejection channel region which is the essential part of the inkjet head 12 shown in FIG. 1.

As shown in FIG. 1, the inkjet recording apparatus 10 includes the inkjet head 12, ink circulation means 14, voltage application means 16, and recording medium support means 18 disposed in a position facing the inkjet head 12.

The inkjet head 12 includes a head substrate 30, a through-hole substrate 32 having through-holes 38, ink guides 34, control electrodes (ejection electrodes) 36, a guard electrode 42 and a floating conductive plate 46. Each of ejection portions 40 has one ink guide 34 and one through-hole 38. An ink flow path indicated by reference numeral 44 is formed between the head substrate 30 and the through-hole substrate 32.

The ink circulation means 14 includes an ink circulation mechanism 50, an ink supply path 52 and an ink recovery path 54. The ink circulation means 14 supplies ink to the inkjet head 12 (mainly to the ejection channel region thereof) at a predetermined flow rate and recovers the supplied ink therefrom. Although not shown, the ink circulation means 14 has a means for replenishing the mechanism where ink (particles) decreased by executing printing operations and a means for storing ink when the apparatus is at rest.

In the inkjet head 12 of the embodiment under consideration, the ejection electrodes 36 and the guard electrode 42 are provided on the head substrate 30 side and the recording medium support means 18 side of the through-hole substrate 32, respectively. Each of the through-holes 38 extends through the through-hole substrate 32 and the ejection electrode 36. The guard electrode 42 is provided in order to achieve the effect of preventing the deviation of the ejected ink droplet from the position at which the ink droplet is to be adhered.

The head substrate 30 is spaced apart from the through-hole substrate 32 by a predetermined distance, and the space defined by these components forms the ink flow path 44 as described above.

The floating conductive plate 46 is provided on the peripheries of the ink guides 34 on the surface of the head substrate 30 facing the through-hole substrate 32. The floating conductive plate 46 is provided in order to achieve the effect of concentrating the dispersed ink particles. The floating conductive plate 46 is provided substantially on the whole surface of the head substrate 30 surrounding the ink guides 34, but the floating conductive plate 46 may be provided only at positions facing the ejection electrodes 36, or in the shape of a strip, plane or mesh covering the above positions.

On the upper surface of the head substrate 30 facing the through-hole substrate 32 are provided the ink guides 34, each of which has a tip protruding from its corresponding through-hole 38 toward the recording medium support means 18 side.

The ejection electrodes 36 are connected to the voltage application means 16 through a wiring portion 48 (partially shown), The wiring portion 48 is also used to connect the guard electrode 42 and the floating conductive plate 46 to grounding means and a specified voltage application means, respectively.

The voltage application means 16 includes a signal voltage source 60 which applies to the ejection electrodes 36 a drive voltage (e.g., pulse voltage) of a predetermined potential corresponding to the ejection data (ejection signal) such as image data and character data, and a bias voltage source 62 which continuously applies a predetermined constant voltage to the ejection electrodes 36.

One terminal (positive terminal in this case) of the signal voltage source 60 is connected to the wiring portion 48 and the other terminal (negative terminal in this case) thereof to one terminal (positive terminal in this case) of the bias voltage source 62. The other terminal (negative terminal in this case) of the bias voltage source 62 is grounded.

The recording medium support means 18 for supporting a recording medium P is provided at a position facing the ink jet head 12, and includes a counter electrode 70 and a bias voltage source 72 for applying a negative high voltage to the counter electrode 70.

The counter electrode 70 is arranged so as to face the ink droplet-ejecting surface of the inkjet head 12. The negative terminal of the bias voltage source 72 is connected to the counter electrode 70 and the positive terminal thereof is grounded. The recording medium P is supported on the surface of the counter electrode 70 facing the ink droplet-ejecting surface of the inkjet head 12.

In order to perform higher density image recording, the inkjet head 12 is preferably of a mutichannel structure as shown in FIG. 1 in which the ejection portions 40 each of which is composed of one ink guide 34 and a through-hole 38 are two-dimensionally arranged together with the ejection electrodes 36.

The respective portions of the inkjet head 12 according to the embodiment under consideration will be described below in detail.

As shown in FIG. 2, an ejection channel region 12*a* is formed on the upper surface of the inkjet head 12 and has the ejection portions 40 formed in, for example, 5 rows along its short side direction, that is, the ink flow direction indicated by an arrow "a" in FIG. 2 and in, for example, 17 columns in the width direction (long side direction) perpendicular to the ink flow direction. In the illustrated example, ink is supplied to the ink flow path 44 in the direction perpendicular to the ink supply path 52 through the ink supply path 52 that has a flow path which enlarges in the longitudinal direction from a tube 52*a* communicating with an ink inlet from the ink circulation mechanism 50 toward the width of the ejection channel region 12*a*. The ink is then supplied from the ink flow path 44 to the respective ejection portions 40 of the ejection channel region 12*a*. The ink is recovered from the ink flow path 44 of the ejection channel region 12*a* in the direction perpendicular to the ink flow path 44 through the ink recovery path 54 that has a flow path narrowing in the longitudinal direction from the width of the ejection channel region 12*a* toward a tube 54*a* communicating with an ink outlet to the ink circulation mechanism 50.

As described above, the object of the present invention is to make uniform the ink ejection from the respective ejection channels in the ejection channel region 12*a* to enable ink droplets of the same size to be consistently ejected under uniform pressure.

Specific examples of the structure for achieving this object will be described below.

The basic feature of the inkjet head 12 according to the embodiment under consideration is that it has a means for making uniform the ink ejection from the respective ejection channels in the ejection channel region 12*a*. Various means can be used to make uniform the ink ejection from the respective ejection channels.

A first means is to locally increase the pressure loss between the ink supply path 52 for supplying ink to the inkjet head 12 and the ejection channel region 12*a*. More specifically, a structure is used in which the ink flow path is bent at right angles from the vertically upward direction to the horizontal direction at the portion where the ink is supplied from the ink supply path 52 to the ejection channel region 12*a*, in other words, at the inlet portion of the inkjet head 12.

By bending the ink flow path at right angles in this way, the flow rate and the pressure of the ink flow are made uniform in the inlet portion of the inkjet head 12 particularly in the width direction of the ejection channel region 12*a*, which enables the ink ejection from the respective ejection channels in the ejection channel region 12*a* to be made uniform. This structure also enables the meniscuses formed in the respective ejection channels of the ejection channel region 12*a* to be made uniform in height.

Another means for making uniform the ink ejection from the respective ejection channels is a structure as shown in FIG. 2 in which the height or the cross-sectional area of the ink flow path in the portion through which the ink flows into the inkjet head 12 is decreased. Specific examples include a structure in which the height of the ink flow path in the portion through which the ink flows into the inkjet head 12 is decreased from $d_1$ to $d_2$, and a structure in which the cross-sectional area of the ink flow path is decreased from $S_1$ to $S_2$.

Reference symbol R shown in FIG. 1 indicates the portion in the ink flow path 44 corresponding to the ejection channel region 12*a*. The structures described above are applied to make uniform the flow rate and the pressure of the ink flow in the portion R.

It is preferred for the portion R not to have a structure that may interfere with the uniform flow rate and pressure of the ink flow, for example, a structure in which a barrier (partition) is provided in a direction perpendicular to the ink flow direction or a structure in which wall surfaces contacting the ink have a large surface roughness.

The distance L (see FIG. 1) between the portion through which the ink flows into the inkjet head 12 and the inlet of the portion R corresponding to the ejection channel region 12*a* should be also called the entrance length (entrance region) for developing the ink flow. The distance L has preferably a value exceeding a certain value. For example, the distance L has desirably a value satisfying the relation:

$$L=0.0065\times Vd_2^2/\nu$$

where V is the flow rate of the ink, $d_2$ is the height of the ink flow path in the ejection channel region 12*a*, and $\nu$ is the kinematic viscosity of the ink.

It is preferable to increase the height of the ink flow path from $d_2$ to $d_3$, or the cross-sectional area from $S_2$ to $S_3$ on the outlet side of the ejection channel region 12*a*. In this case, the height $d_1$ and the cross-sectional area $S_1$ of the ink flow path may be the same as or different from the height $d_3$ and the cross-sectional area $S_3$, respectively.

The above-mentioned structure in which the ink flow path is bent at right angles from the vertically upward direction to the horizontal direction in the inlet portion of the inkjet head 12 may be replaced by the structure in which a baffle plate is provided in the inlet portion of the inkjet head 12 (preferably in the vicinity of the starting point of the entrance length L) in a direction orthogonal to the ink flow or at an angle exceeding a certain value.

In this case, the shape and material of the baffle plate are preferably selected so that the uniformity of the ink flow is not degraded. In a particularly preferred structure, a porous material can be used to further enhance the uniformity of the ink flow. There are no particular limitations on the material, pore size and porosity of the porous material used.

It is needless to say that, in the portion contacting the ink flow within the region R of the flow path corresponding to the ejection channel region 12*a*, in short, in the ink-contacting portion, the wall surfaces have preferably a small surface roughness. However, it is preferable for the wall surfaces to be further subjected to a treatment (coating treatment) to make them liquid repellent or receptive to thereby reduce the resistance in the flow path.

There is no particular limitation on the material used in the coating treatment, and any material can be used as long as the material used does not adversely affect the ink material.

Instead of performing the coating treatment as described above, it is of course effective for the whole (or only the portions near the surfaces) of the components located in the ink-contacting portion within the portion R corresponding to the ejection channel region 12*a* to be made of a material which is highly repellent or receptive to liquid and has a small surface roughness as described above.

It is also effective to use a nanostructured or microstructured pillar or slit in the liquid repellent or receptive portion as described above. For example, such structure enables the pressure loss to be reduced to about 20% or less.

In addition to the various structures described above, a structure in which the area of the wall surfaces in the ink flow path contacting the ink is decreased is also effectively used in order to reduce the resistance during the passage of the ink through the ink-contacting portion within the portion R corresponding to the ejection channel region 12*a*. Assuming here that a flow path with a square cross section and a flow path with a circular cross section are identical in cross-sectional area, the ink-contacting area of the latter is $\sqrt{\pi}/2$ times (about 0.89 times) as large as the former.

A structure whose concept is different from that of the structure illustrated above will be described below.

Figure 3:
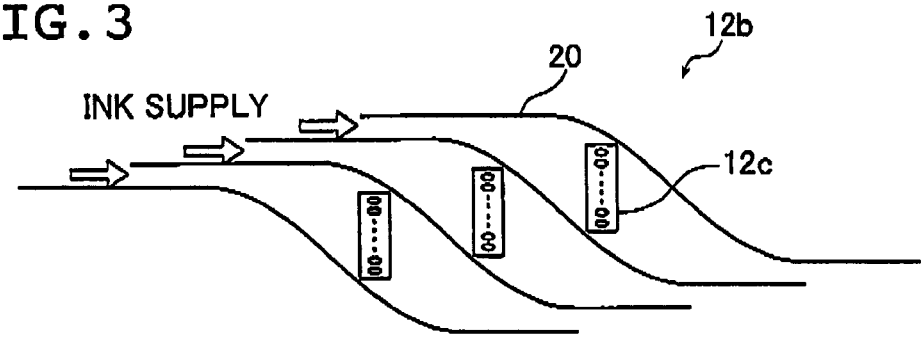
FIG. 3 is a plan view schematically showing the ejection channel region according to another embodiment.

FIG. 3 is a plan view schematically showing the ejection channel region 12*b* according to another embodiment. FIG. 3 shows discrete ejection channel regions 12*c* each corresponding to the ejection portions in one row of the ejection channel region 12*a* described above. Partitions 20 for dividing the ink supply path 52 into several segments are also shown.

In the structure shown in FIG. 3, each of the ejection channel regions 12*c* is arranged so as to have an ink supply path exclusively used therefor, and the structure is advantageous in that an adjustment for making uniform the amount of ink to be supplied to each of the ejection channel regions 12*c* can be readily made.

In this embodiment, each of the ejection channel regions 12*c* has a row of ejection portions but a structure in which each ejection channel region is composed of two or more rows may of course be applied.

Various structures including the one relying on the coating treatment as described above can also be used in the inkjet head of this embodiment in order to reduce the resistance of the partitions 20 against the contact with the ink flow.

The liquid ejection head of the present invention has been described above with reference to the various embodiments. Then, in Example, a simulation was performed for the structure of a typical embodiment as shown in FIG. 2 in which the height of the ink flow path was reduced in the portion through which the ink flowed into the inkjet head 12, and this Example and Comparative Example corresponding thereto are shown below.

EXAMPLE AND COMPARATIVE EXAMPLE

The following Example and Comparative Example are experimental examples in which simulated inkjet heads intended for simulation purposes was used. The simulated inkjet heads had the same geometry as that used in the actual apparatus but did not include members (e.g., ink guides and through-holes) forming the actual ejection portions.

Figure 4:
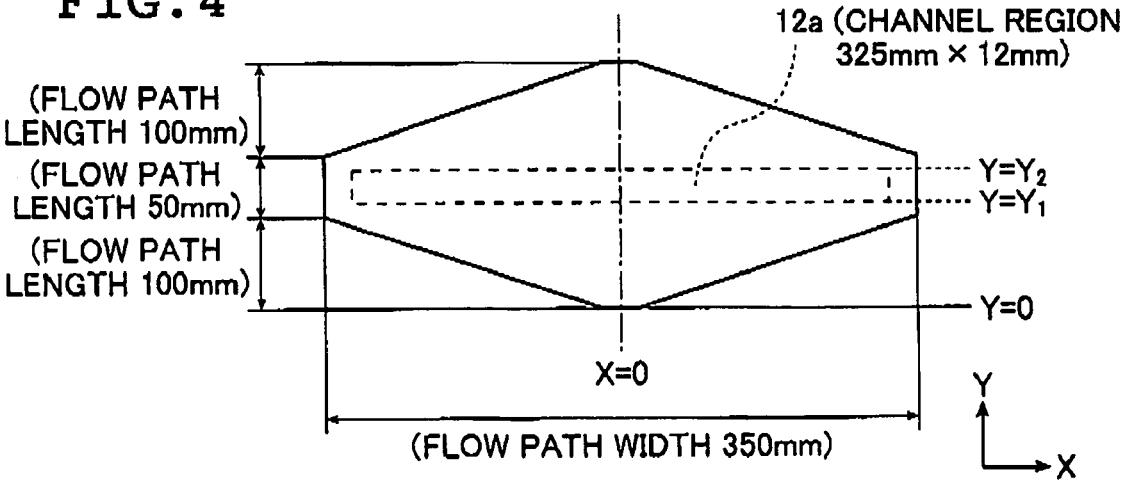
FIG. 4 is a plan view of a simulated inkjet head for use in simulating the electrostatic ejection head according to an embodiment.

FIG. 4 shows a plan view of a simulated inkjet head. The dimensions of the respective portions are shown in detail in FIG. 4. The direction indicated by Y in FIG. 4 is the ink flow direction. The interval between $Y_1$ and $Y_2$ in the Y direction indicates the region R corresponding to the ejection channel region 12*a* and the interval between Y=0 and $Y=Y_1$ corresponds to the entrance length L over which the ink flows.

Prior to referring to the simulations in Example and Comparative Example, it is to be noted that there is a different point between Example and Comparative Example: In Example, the height of the ink flow path is reduced in the portion through which the ink flows into the inkjet head and the height of the ink flow path in the entrance region (having the length L) is 2 mm and that in the ejection channel region is 200 μm (0.2 mm), whereas the height of the ink flow path is 2 mm over the whole length in Comparative Example.

Figure 5A:
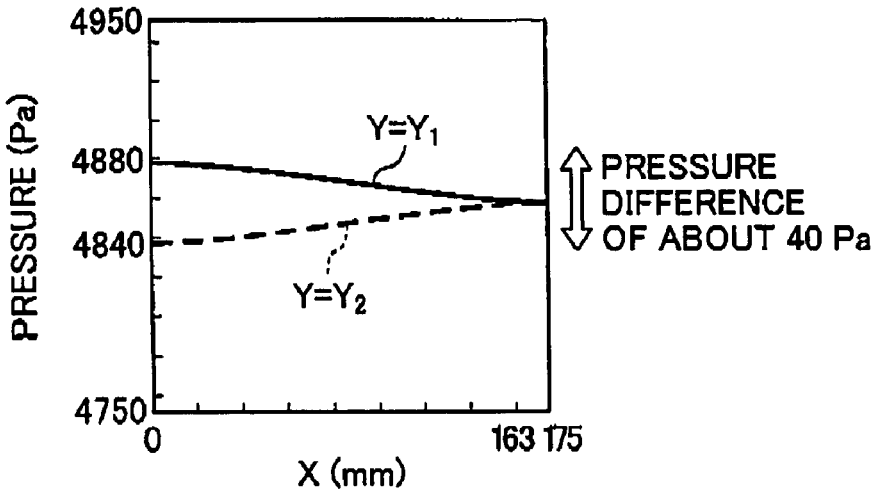
FIGS. 5A and 5B are graphs showing the simulation results obtained with the simulated inkjet head in Comparative Example.
Figure 5B:
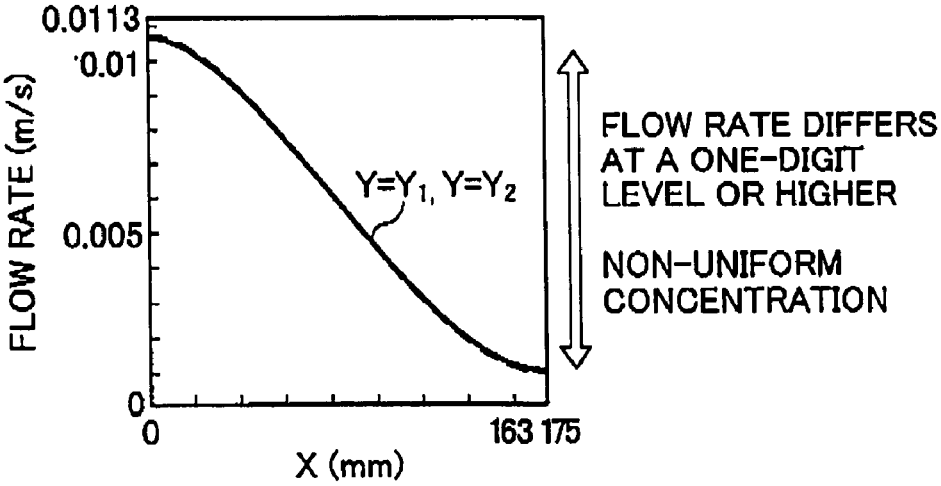
Figure 6A:
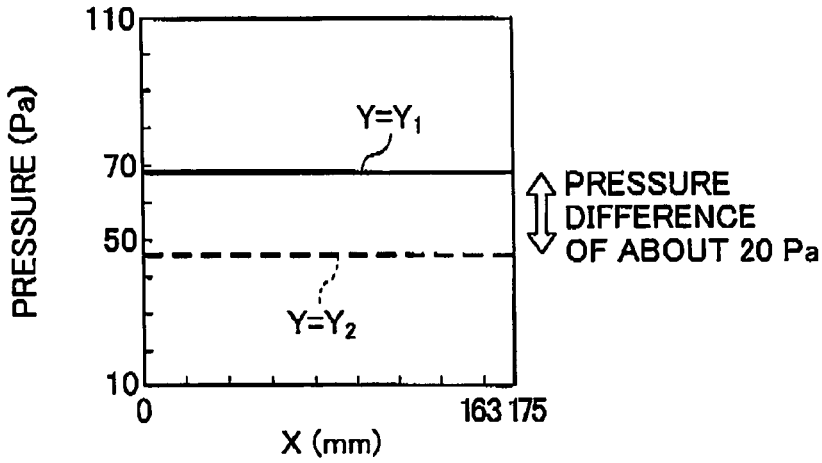
FIGS. 6A and 6B are graphs showing the simulation results obtained with the simulated inkjet head in Example.
Figure 6B:
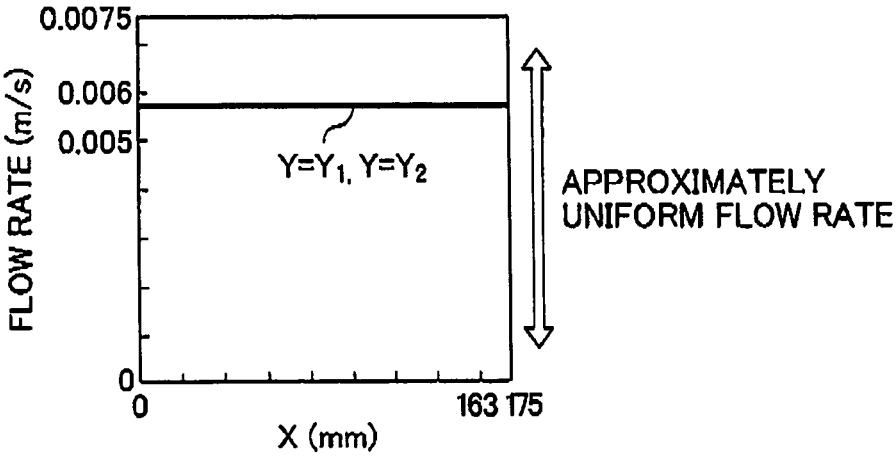
Figure 7:
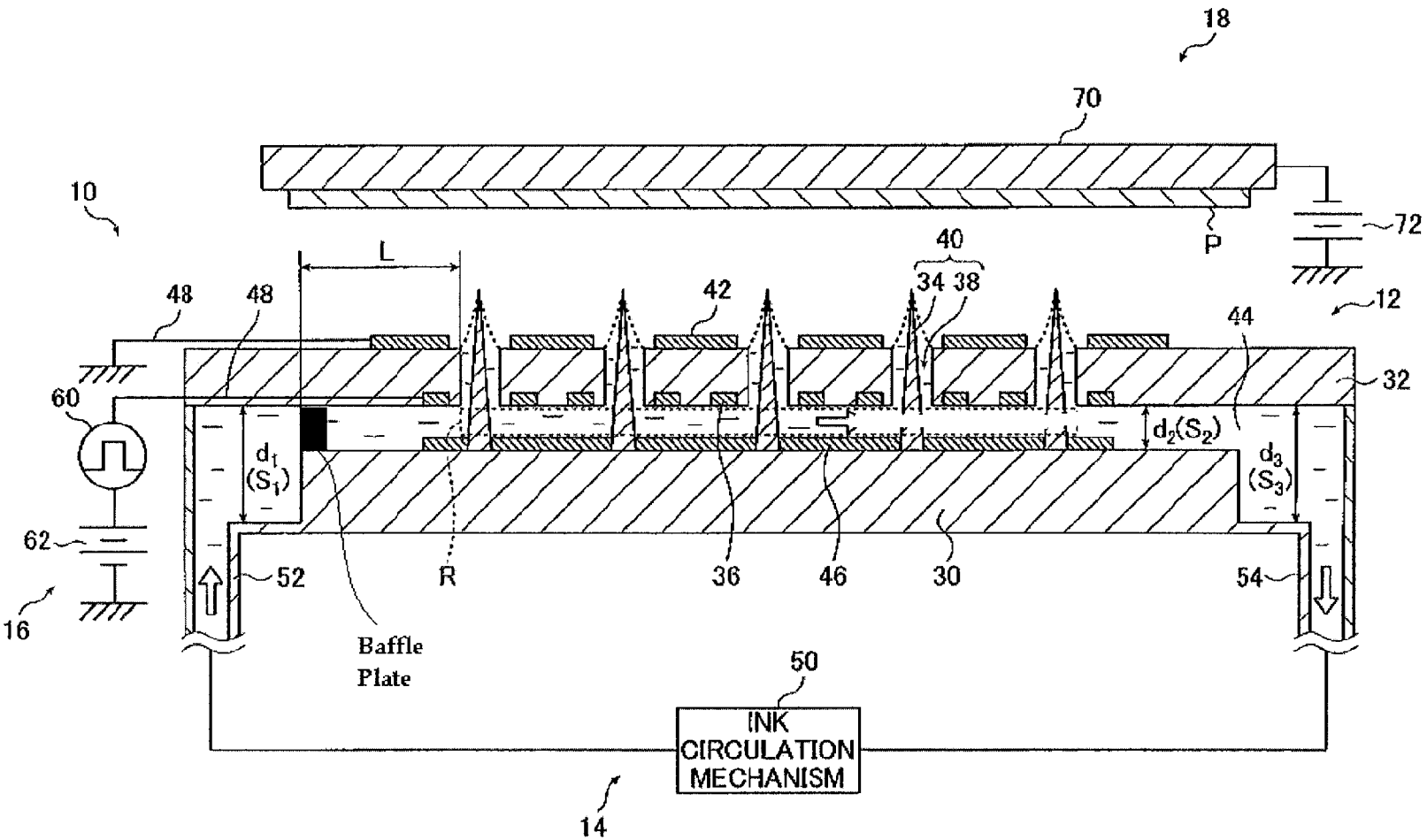
FIG. 7 is a schematic view of an inkjet recording apparatus indicating the baffle plate according to an embodiment.
Figure 8:
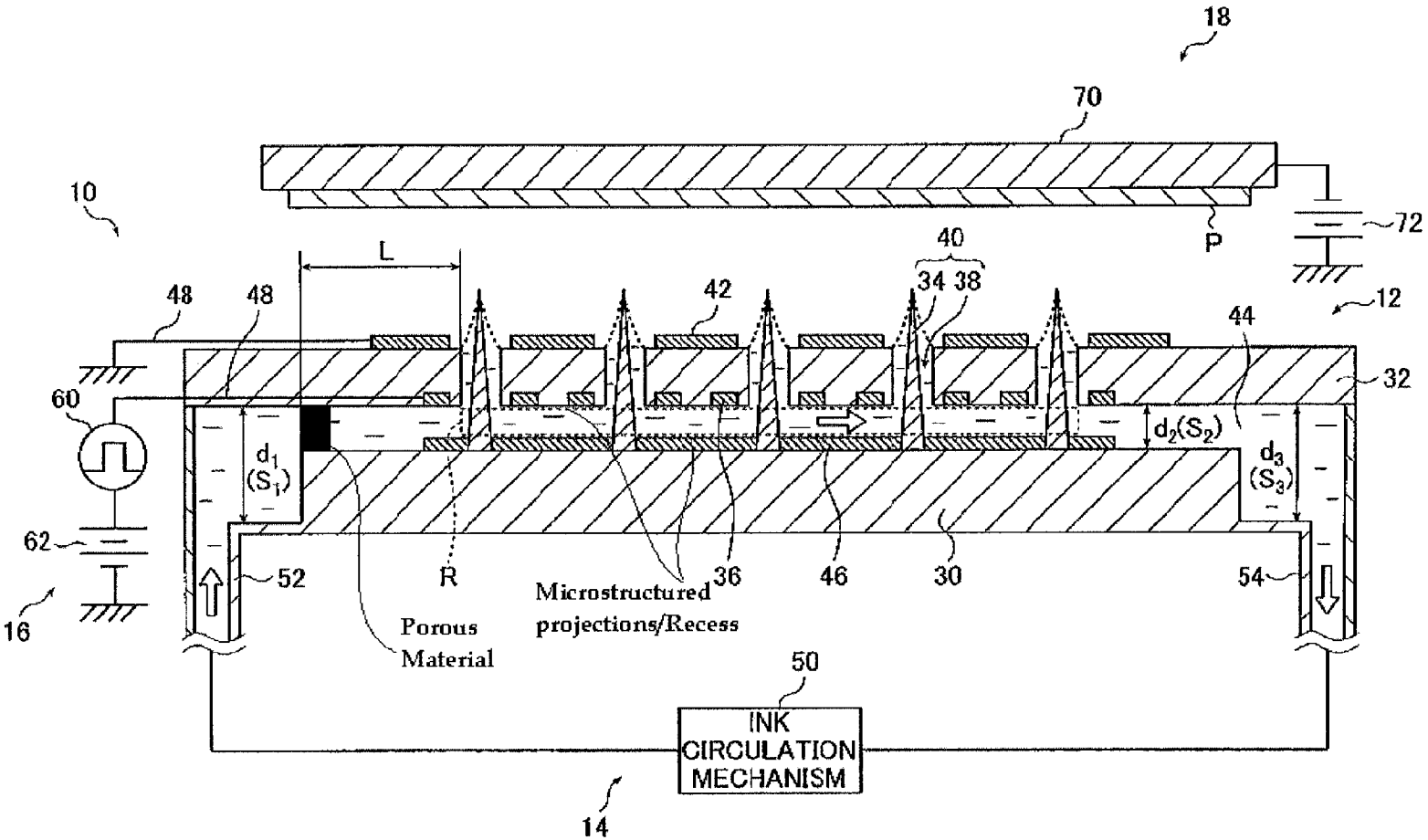
FIG. 8 is a schematic view of an inkjet recording apparatus indicating porous material and microstructured projection/recess according to an embodiment.

FIGS. 5A and 5B are graphs showing the simulation results obtained with the simulated inkjet head in Comparative Example, and FIGS. 6A and 6B are graphs showing the simulation results obtained with the simulated inkjet head in Example. FIGS. 5A and 6A show the uniformity in the ink pressure in the portion corresponding to the portion R of the ink flow path 44 corresponding to the ejection channel region 12*a* (hereinafter referred to as the portion corresponding to R), and FIGS. 5B and 6B show the uniformity in the ink flow rate in the portion corresponding to R. In the simulations of Example and Comparative Example shown in FIGS. 5A, 5B, 6A and 6B, the average flow rate was set to be the same.

Now referring to the graphs of FIGS. 5A and 5B which show the simulation results in Comparative Example, unsatisfactory results are obtained in both of the uniformity in the ink pressure in FIG. 5A and the uniformity in the ink flow rate in FIG. 5B. More specifically, as for the uniformity in the ink pressure in FIG. 5A, it is seen that the ink pressure considerably varies in the width direction of the simulated inkjet head (horizontal direction in FIG. 5A) and there is a difference of about ±20 Pa between the end (X=163 for example) and the center (X=0).

As for the uniformity in the ink flow rate in FIG. 5B, it is seen that the flow rate markedly varies in the width direction (horizontal direction in FIG. 5B as above) over the distance of about 170 mm and the inkjet head is by no means adequate for practical use. As also described in FIG. 5B, the flow rate differs at a one-digit level or higher between the ink flow before reaching the portion corresponding to R and the ink flow having passed therethrough. In the case where the flow rate differs to such an extent, the ink could concentrate in a considerably non-uniform manner.

Referring to the graphs of FIGS. 6A and 6B which show the simulation results in Example, highly satisfactory results are obtained in both the uniformity in the ink pressure in FIG. 6A and the uniformity in the ink flow rate in FIG. 6B. More specifically, as for the uniformity in the ink pressure in FIG. 6A, the ink pressure differs to some extent between the ink before reaching the portion corresponding to R and the ink having passed therethrough, whereas no substantial difference is observed in the width direction (horizontal direction in FIG. 6A). The difference in the ink pressure in the direction along the portion corresponding to R causes no problem in the actual inkjet image formation.

As for the uniformity in the ink flow rate in FIG. 6B, no substantial difference is observed not only in the width direction (horizontal direction in FIG. 6B) but also in the direction along the portion corresponding to R and it is seen that the uniformity in the ink flow rate is achieved over the whole region in a substantially complete manner.

The simulation results in Example show a high degree of effectiveness of the structure in the above-mentioned embodiment in which ejection of the solution from the respective ejection channels in the ejection channel region is made uniform.

While the liquid ejection head of the present invention has been described above in detail with reference to the various embodiments and examples, the invention is by no means limited thereto and various improvements and modifications can of course be made without departing from the scope and spirit of the invention.

In addition to the above-mentioned structure in which the blocks and the ink supply path are arranged on a horizontal plane, a structure composed of a three-dimensionally combined arrangement is also effective to supply a solution to each block composed of more than one channel in the ejection channel region.

What is claimed is:

1. A liquid ejection head comprising:

ejection ports which eject as droplets a solution containing colorant particles dispersed therein; and means for making uniform ejection of said solution from respective ejection channels in an ejection channel region where said ejection ports are arranged, wherein said means for making uniform the ejection of said solution from said respective ejection channels comprises means for locally increasing a pressure loss between a solution supply path for supplying said solution and said ejection channel region.

2. A liquid ejection head comprising:

ejection ports which eject as droplets a solution containing colorant particles dispersed therein; and means for making uniform ejection of said solution from respective ejection channels in an ejection channel region where said ejection ports are arranged, wherein said means for making uniform the ejection of said solution from said respective ejection channels comprises means for making uniform one or both of a flow rate and a pressure at which said solution is supplied to said respective ejection channels of said ejection channel region.

3. A liquid ejection head of electrostatic type that makes an electrostatic force to act on a solution containing charged particles dispersed therein to eject droplets, comprising:

an insulating through-hole substrate through which through-holes for ejecting said droplets extend;

an insulating head substrate which is spaced apart from said insulating through-hole substrate by a predetermined distance, with a solution flow path being formed between said insulating through-hole substrate and said insulating head substrate;

solution guides which are formed on a surface of said insulating head substrate facing said insulating through-hole substrate, with their tips extending through and protruding from said insulating through-hole substrate;

control electrodes which are provided at positions corresponding to said through-holes and causes said electrostatic force to act on said solution;

a counter electrode which is provided at a position facing said solution guides; and means for making uniform ejection of said solution from respective ejection channels in an ejection channel region where said solution guides are arranged, wherein said means for making uniform ejection of said solution from said respective ejection channels comprises means for locally increasing a pressure loss between a solution supply path for supplying said solution and said ejection channel region.

4. The liquid ejection head according to claim 3, wherein said means for making uniform the ejection of said solution from said respective ejection channels comprises means for making uniform flow rates and pressures in a solution-flowing direction and in a width direction by locally increasing the pressure loss per unit length between said solution supply path and said ejection channel region.

5. The liquid ejection head according to claim 4, wherein said means for making uniform the flow rates and the pressures in the solution-flowing direction and in the width direction comprises a baffle plate provided in said solution flow path.

6. The liquid ejection head according to claim 4, wherein said means for making uniform the flow rates and the pressures in the solution-flowing direction and in the width direction comprises a porous member provided in said solution flow path.

7. The liquid ejection head according to claim 4, wherein said means for making uniform the flow rates and the pressures in the solution-flowing direction and in the width direction comprises uneven structures having adjusted roughness and formed in said solution flow path or wall surfaces of said solution flow path having adjusted roughness.

8. The liquid ejection head according to claim 4, wherein said means for making uniform the flow rates and the pressures in the solution-flowing direction and in the width direction comprises means for changing typical sizes of said solution flow path between said solution supply path and said ejection channel region.

9. The liquid ejection head according to claim 3, wherein said means for locally increasing the pressure loss comprises means for changing between said solution supply path and said ejection channel region, a direction in which said solution mainly flows.

10. A liquid ejection head of electrostatic type that makes an electrostatic force to act on a solution containing charged particles dispersed therein to eject droplets, comprising:

an insulating through-hole substrate through which through-holes for ejecting said droplets extend;

an insulating head substrate which is spaced apart from said insulating through-hole substrate by a predetermined distance, with a solution flow path being formed between said insulating through-hole substrate and said insulating head substrate;

solution guides which are formed on a surface of said insulating head substrate facing said insulating through-hole substrate, with their tips extending through and protruding from said insulating through-hole substrate;

control electrodes which are provided at positions corresponding to said through-holes and causes said electrostatic force to act on said solution;

a counter electrode which is provided at a position facing said solution guides; and means for making uniform ejection of said solution from respective ejection channels in an ejection channel region where said solution guides are arranged, wherein said means for making uniform the ejection of said solution from said respective ejection channels comprises means for making uniform one or both of a flow rate and a pressure at which said solution is supplied to said respective ejection channels of said ejection channel region.

11. The liquid ejection head according to claim 10, wherein said means for making uniform said one or both of the flow rate and the pressure at which said solution is supplied to said respective ejection channels of said ejection channel region comprises means for supplying said solution to blocks each composed of more than one channel in said ejection channel region.

12. The liquid ejection head according to claim 11, wherein said means for supplying said solution to blocks each composed of said more than one channel in said ejection channel region supplies said solution in parallel to blocks each composed of more than one channel in said ejection channel region.

13. The liquid ejection head according to claim 11, wherein said blocks each composed of said more than one channel are separated from each other by partitions.

14. A liquid ejection head of electrostatic type that makes an electrostatic force to act on a solution containing charged particles dispersed therein to eject droplets, comprising:

an insulating through-hole substrate through which through-holes for ejecting said droplets extend;

an insulating head substrate which is spaced apart from said insulating through-hole substrate by a predetermined distance, with a solution flow path being formed between said insulating through-hole substrate and said insulating head substrate;

solution guides which are formed on a surface of said insulating head substrate facing said insulating through-hole substrate, with their tips extending through and protruding from said insulating through-hole substrate;

control electrodes which are provided at positions corresponding to said through-holes and causes said electrostatic force to act on said solution;

a counter electrode which is provided at a position facing said solution guides; and means for making uniform ejection of said solution from respective ejection channels in an ejection channel region where said solution guides are arranged, wherein said means for making uniform ejection of said solution from said respective ejection channels comprises means for reducing a pressure loss per unit length in said ejection channel region to make meniscuses formed in said respective ejection channels of said ejection channel region uniform in height.

15. The liquid ejection head according to claim 14, wherein said means for reducing the pressure loss per unit length in said ejection channel region comprises means for decreasing a contact area of wall surfaces of said solution flow path which make contact with said solution in said ejection channel region.

16. The liquid ejection head according to claim 15, wherein said wall surfaces of said solution flow path in said ejection channel region which make contact with said solution are subjected to a coating treatment.

17. The liquid ejection head according to claim 15, wherein said wall surfaces of said solution flow path in said ejection channel region which make contact with said solution are provided with microstructured projections or recesses.

* * * * *